United States Patent [19]

Goss et al.

[11] 4,067,447

[45] Jan. 10, 1978

[54] SAFETY DEVICE FOR CRANES

[76] Inventors: John B. Goss, 7627 Beech Cove Lane; William D. Morrow, 10206 Amblewood, both of, Houston, Tex. 77072

[21] Appl. No.: 644,808

[22] Filed: Dec. 29, 1975

[51] Int. Cl.[2] ..... B66C 13/48

[52] U.S. Cl. ..... 212/86; 212/39 B; 212/132; 92/133; 91/358 A

[58] Field of Search ..... 212/39 R, 39 B, 39 DB, 212/39 MS, 39 A, 39 P, 37, 86, 132; 214/762, 764, 673; 254/174; 340/267 C; 92/108, 109, 130 C, 133; 91/392, 403, 358 A

[56] References Cited

U.S. PATENT DOCUMENTS

| | | | |
|---|---|---|---|
| 1,834,985 | 12/1931 | Stoner | 212/39 B |
| 2,635,627 | 4/1953 | McCarthy | 92/130 C |
| 2,744,637 | 5/1956 | Stewart | 212/39 DB |
| 2,955,578 | 10/1960 | Flessate et al. | 92/108 |
| 3,035,712 | 5/1962 | Nowack | 212/39 MS |
| 3,613,520 | 10/1971 | Worden | 92/133 |
| 3,670,628 | 6/1972 | Borer et al. | 91/358 A |
| 3,924,752 | 12/1975 | Hoffnagle | 212/39 MS |
| 3,929,245 | 12/1975 | Inoue | 91/358 A X |

FOREIGN PATENT DOCUMENTS

| | | | |
|---|---|---|---|
| 283,230 | 10/1965 | Australia | 212/39 B |
| 617,330 | 2/1927 | France | 91/359 |
| 347,459 | 1/1922 | Germany | 212/39 R |
| 681,442 | 10/1952 | United Kingdom | 212/86 |

*Primary Examiner*—Robert J. Spar
*Assistant Examiner*—R. B. Johnson
*Attorney, Agent, or Firm*—Pravel, Wilson & Gambrell

[57] ABSTRACT

An anti-two block system adapted to be used with a crane having a sensor device mounted with the boom point of the crane in communication with a hoisting actuator mechanism such that the sensor device effects movement of the hoisting lever of the crane to discontinue the lifting force exerted on the lifting line when the travelling member engages the sensor device.

11 Claims, 5 Drawing Figures

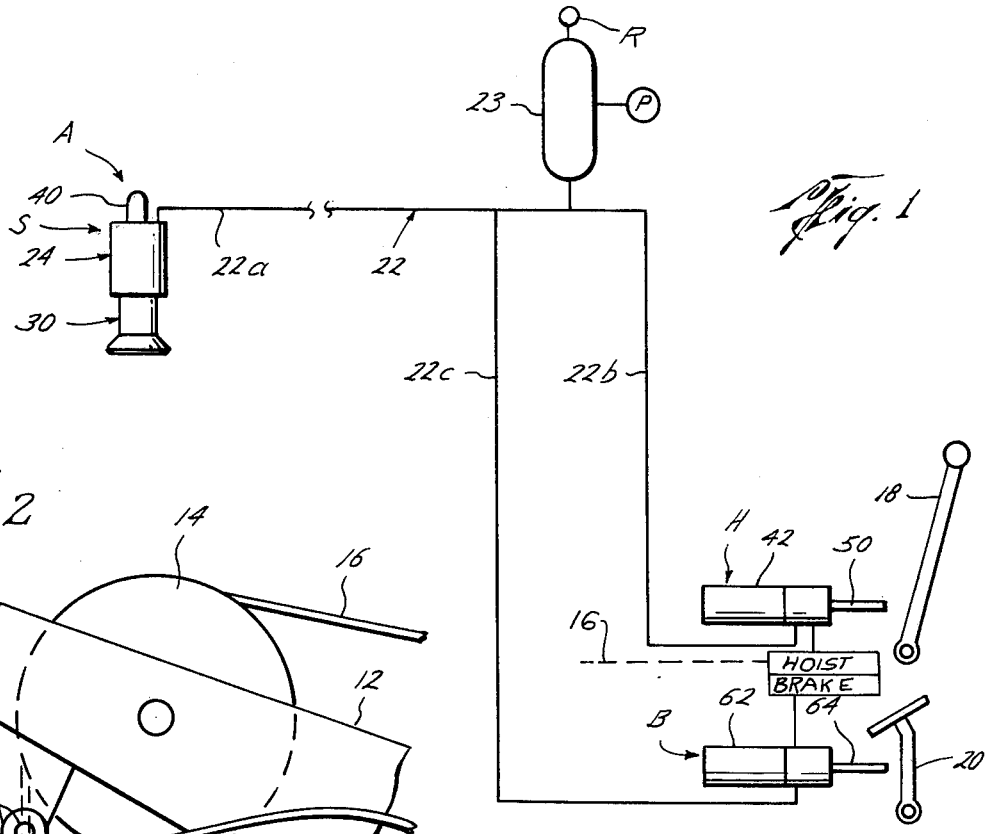
Fig. 1
Fig. 2
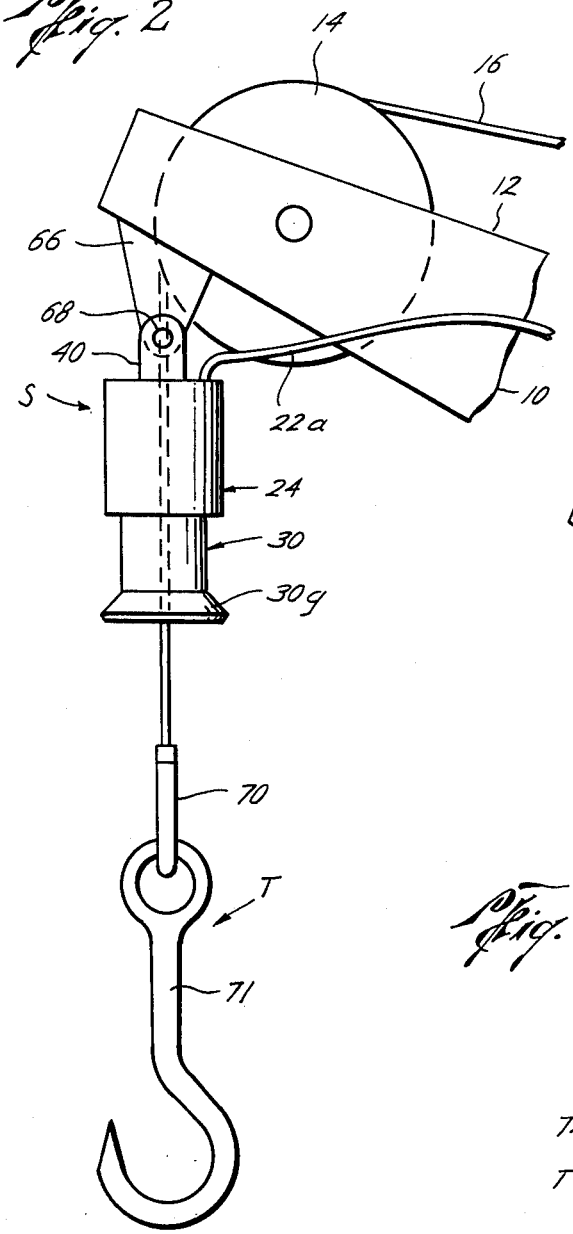
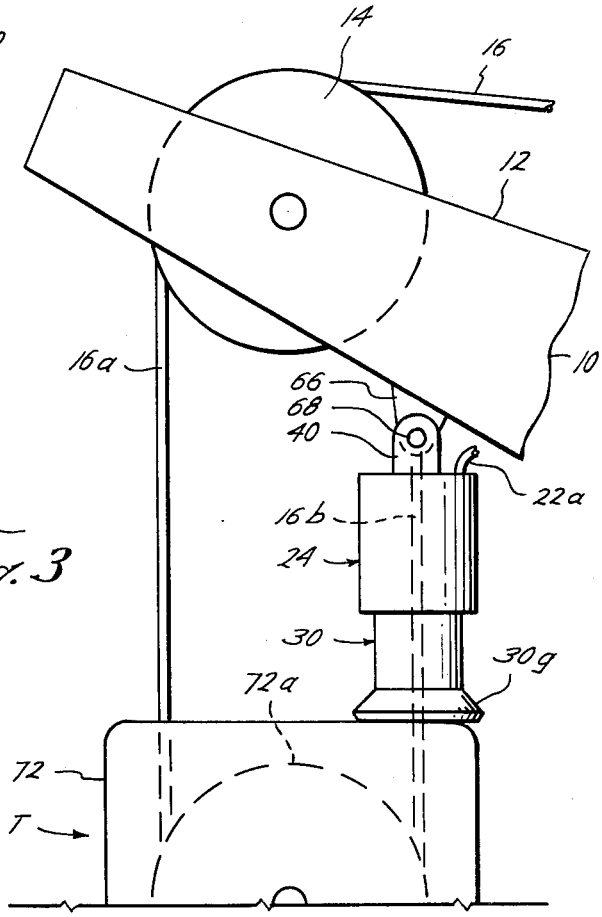
Fig. 3

SAFETY DEVICE FOR CRANES

BACKGROUND OF THE INVENTION

The field of this invention is sensing systems, particularly of the type used on cranes to detect two blocking situations.

For lifting devices of all types, two blocking, as it is called, provides a very significant health and safety factor for those working about such a lifting operation. Two blocking is the lifting by the lifting line of a travelling member up into the uppermost supporting member resulting in damage to the uppermost portion of the supporting member and the sheaving mechanism therewith, the travelling block and/or the load. This two blocking situation typically occurs when the lifting line is hoisted too rapidly with the operator not paying proper attention to the proximity of the travelling member to the supporting member, such as a boom point of a boom of a crane, resulting in the travelling member colliding with the supporting member with resultant damage to both. Not only is there substantial risk that the lifting line may snap in such a situation resulting in a free falling load with the potential dangers to those below, the line may also snap and whip into proximity of the operator resulting in substantial risk of injury thereto.

SUMMARY OF THE INVENTION

The present invention relates to a new and improved anti-two block system adapted to be used with a crane having sensing means mounted with the boom point of the crane for detecting the close proximity of the travelling member adjacent the boom point of the crane during lifting operations of the travelling member with the crane and a hoisting actuator device mounted adjacent the hoisting lever of the crane for co-action therewith, the hoisting actuator device being operatively connected with the sensor device for effecting movement of the hoisting lever to discontinue the lifting force exerted on the lifting line when the travelling member engages the sensing device.

DESCRIPTION OF THE DRAWINGS

FIG. 1 is a schematic of the circuitry of the anti-two block system of the present invention;

FIG. 2 is an elevational view of the sensor means of the anti-two block system of the present invention mounted with a boom point as used with live line crane installation;

FIG. 3 is an elevational view of the sensor means of the anti-two block system of the present invention mounted with a boom point as used with a dead line crane installation;

DESCRIPTION OF THE PREFERRED EMBODIMENT

Figure 4:
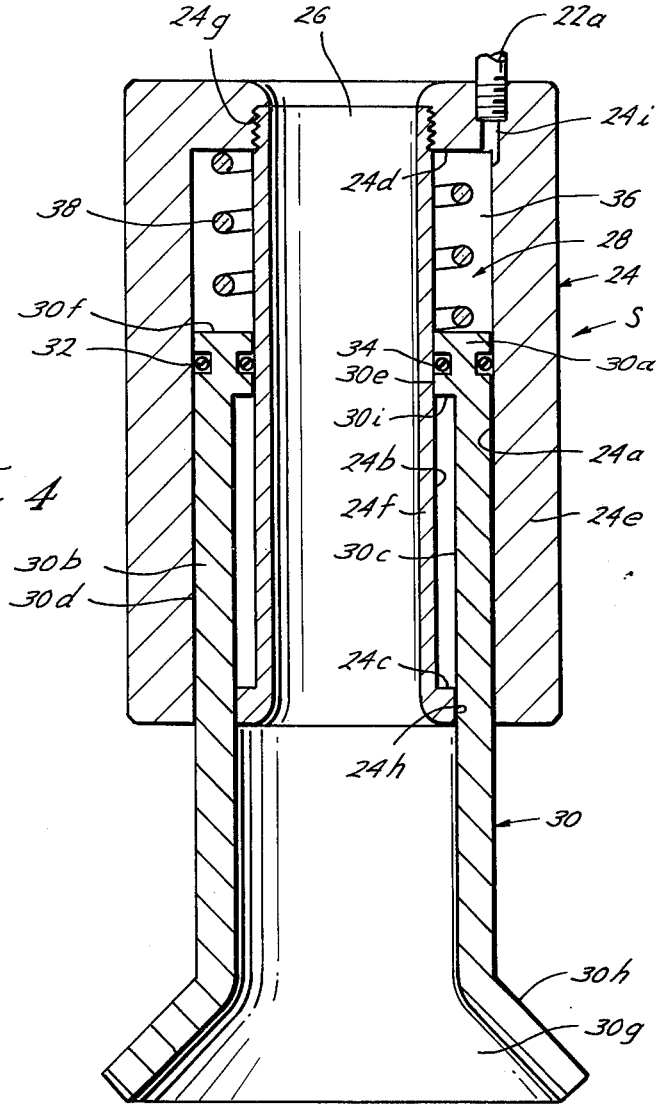
FIG. 4 is a sectional view of the sensor means of the anti-two block system of the present invention; and, FIG. 5 is a sectional elevational view of the actuator means of the anti-two block system of the present invention.

In the drawings, the letter A designates the anti-two block system of the present invention. The anti-two block system A includes a sensor means S for activating a hoisting actuator means H and brake actuator means B. Unless otherwise noted, the components of this invention are made of steel capable of taking heavy stresses and strains without failure, although other suitable high-strength materials may be used if desired.

The anti-two block system A of the present invention is adapted to be used with any lifting device, however preferably a crane (not shown). Typically, a crane has a boom 10 having a boom point 12 on the boom 10 adjacent the furthermost extremity from the upperworks (not shown) of the crane. Typically, a sheave 14 is mounted adjacent the boom point 12 and capable of receiving the lifting line 16. The lifting line 16 is typically affixed at one end to a hoisting drum (schematically shown in FIG. 1) mounted with the crane and extends along the length of the boom 10, thereover the sheave 14 and connected to a travelling member T. The hoisting drum is typically activated by a hoisting lever 18 (FIG. 1) affixed to the upperworks (not shown) of the crane for activation by the operator for lifting and lowering of the travelling member T. Furthermore, the crane typically has a brake lever 20 operatively connected to a conventional brake means which is schematically shown in FIG. 1 and similarly affixed with the upperworks (not shown) of the crane for stopping the movement of the lifting line 16 by directly engaging the lifting line 16, the hoisting drum, or in any other suitable fashion stopping movement of the lifting line 16.

As schematically shown in FIG. 1, the sensor means S, hoisting actuator means H and brake actuator means B are joined together by a means operatively connecting the sensor means S, hoisting actuator means H and brake actuator means B theretogether such as by fluid line 22 or, in any other suitable fashion interconnected. As shown in FIG. 1, the fluid line 22 is affixed to the sensor means S adjacent fluid line segment **22*a* which is in fluid communication with fluid line segment 22*b* affixed to the hoisting actuator means H and the fluid line segment 22*c* affixed with the brake actuator means B as discussed more fully hereinbelow. An accumulator 23 is appropriately connected therewith fluid line 22** and receives hydraulic pressure from a suitable pump P.

The anti-two block system A of the present invention includes a sensor means S as shown in FIG. 4. The sensor means S is preferably of a cylindrical configuration, however, any other suitable configuration may be used. The sensor means S includes a body member 24 having a bore 26 formed therethrough for receivably mounting the lifting line 16 of the crane therein and further having a fluid cavity 28 formed about the bore 26. The fluid cavity 28 is preferably of a cylindrical configuration and is defined by annular surface **24*a*, annular surface 24*b*, end surface 24*c* and end surface 24*d* of the body member 24. As shown in FIG. 4, the body member 24 is preferably of two-piece construction having an outer body member 24*e* and an inner body member 24*f*. Thus, surfaces 24*a*, 24*d* are formed with the outer body member 24*e* and surfaces 24*b*, 24*c* are formed with the inner body member 24*f*. The inner body member 24*f* is threadedly mounted with outer body member 24*e* by threads 24*g*** to facilitate ease in manufacturing and disassembly of the sensor means S.

A sleeve 30 is adapted to be mounted with fluid cavity 28. The sleeve 30 includes a first end **30*a* adapted to be disposed within the fluid cavity 28 having a preferably cylindrical longitudinal portion 30*b* having inner annular surface 30*c* and outer annular surface 30*d*. Outer annular surface 30*d* is of a diameter slightly less than the annular surface 24*a* of the outer body member 24*e* such that the sleeve 30 may be appropriately disposed within the fluid cavity 28 having seal 32 therebetween surfaces 30***d*, 24*a* for preventing fluid leakage therebetween. In similar fashion, seal 34 mounted with the first end 30*a* of the sleeve 30 sealably engages annular surface 24*b* to prevent fluid migration therebetween surface 24*b* and upper annular surface 30*e* of sleeve 30. The sleeve 30 extends from the upper end surface 30*f* along the longitudinal portion 30*b* to the second end 30*g* having a depending flange portion 30*h*. The inner annular surface 30*c* of the sleeve 30 is adapted to be movably affixed adjacent to annular surface 24*h* formed about the lower end of the inner body member 24*f*. A fluid chamber 36 is formed therebetween the first end 30*a* of the sleeve 30 and the body member 24 and is defined by upper end surface 30*f* of sleeve 30, annular surface 24*a*, 24*b* and end surface 24*d* of the body member 24. As the sleeve 30 moves with respect to the body member 24, the volumetric capacity of the fluid chamber 36 changes. Bias means such as spring 38 or any other suitable biasing device is preferably mounted in the fluid chamber 36 for providing a bias on the sleeve 30 to result in the sensor means S remaining in a first, unactivated position. In such a first, unactivated position, the sleeve 30 is fully extended along the length of the longitudinal portion 30*b* such that end surface 30*i* of sleeve 30 contacts end surface 24*c* of the inner body member 24*f*. The spring 38 acting therebetween end surface 24*d* of the outer body member 24*e* and the upper end surface 30*f* of the sleeve 30 results in the sleeve remaining in such an unactivated position. A fluid port 24*i* is formed adjacent end surface 24*d* in the outer body member 24*e* and adapted to receive fluid line segment 22*a* for communicating therewith fluid chamber 36. Thus, movement of the sleeve 30 with respect to the body member 24 results in the displacement of fluid from within the fluid chamber 36 outwardly therethrough fluid port 24*i* into fluid line segment 22*a*. Mounting tabs 40 are preferably secured to the body member 24 adjacent the upper end thereof for mounting the body member 24 with the boom point 12 of the boom 10 as will be discussed more fully hereinbelow.

The anti-two block system A of the present invention includes hoisting actuator means H and brake actuator means B. The hoisting actuator means H is preferably mounted adjacent the hoisting lever 18 for co-action therewith. The brake actuator means B is preferably mounted adjacent the braking lever 20 for co-action therewith. Preferably, the hoisting actuator means H and the brake actuator means B are substantially of the same configuration as shown in FIG. 5 and therefore the discussion of FIG. 5 though directed to the hoisting actuator means H is applicable also to the brake actuator means B.

Figure 5:
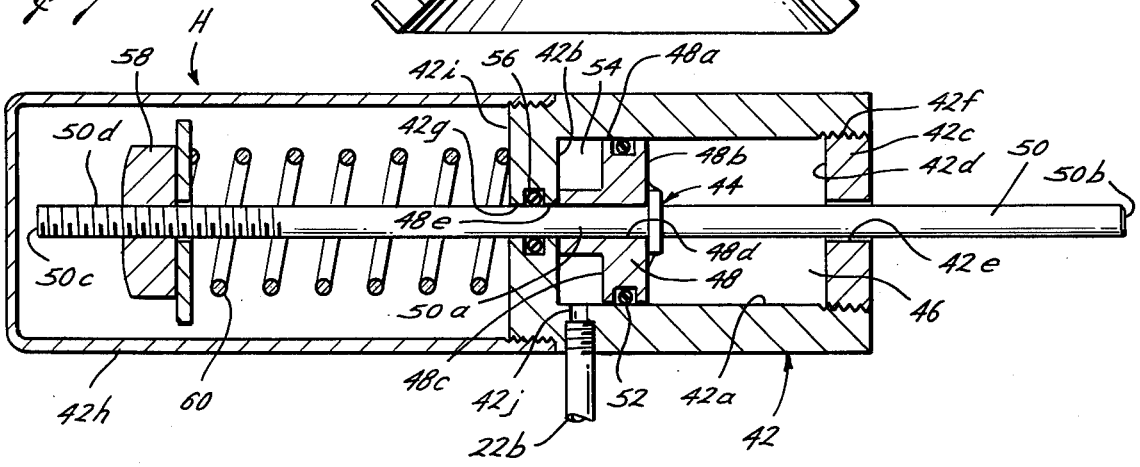

As shown in FIG. 5, the hoisting actuator means H includes an activator housing 42 and a piston assembly 44. The activator housing 42 is preferably of a cylindrical configuration, however any other suitable configuration may be used. The activator housing 42 has an inner annular surface 42*a*, an inner end surface 42*b* and a removable end plate 42*c* having interior surface 42*d* and opening 42*e* formed therein in plate 42*c*. The removable end plate 42*c* is mounted with the activator housing 42 by threads 42*f* or any other suitable attaching means. A fluid cavity 46 is formed by surfaces 42*a*, 42*b*, 42*d*. The piston assembly 44 is preferably disposed within the fluid cavity 46. The piston assembly 44 includes a piston 48 having rod 50 mounted therewith. The piston 48 is adapted to be disposed within the fluid cavity 46. Inner surface 48*a* of piston 48 adjacent surface 42*a* of the activator housing 42 is in sealable relation therewith by means of seal 52 mounted with piston 48 for preventing fluid migration therebetween such surfaces 48*a*, 42*a*. The piston 48 further includes end surfaces 48*b*, 48*c*, 48*e*. A fluid chamber 54 is defined by end surface 48*c*, annular surface 42*a* and inner end surface 42*b*. Preferably, an opening 48*d* is formed within the central portion of piston 48 adapted to receivably mount rod 50 therewith adjacent midportion 50*a* of the rod 50. The rod 50 is adapted to extend through opening 42*e* formed in the end plate 42*c* as well as opening 42*g* formed adjacent end surfaces 42*b*, 42*i* having seal 56 mounted with opening 42*g* for sealably mounting the rod 50 therewith.

The activator housing 42 further includes protective covering 42*h* for protecting that part of the rod 50 that extends therefrom opening 42*g* outwardly from the fluid cavity 46. The rod 50 includes a first end 50*b* and a second end 50*c* having threads 50*d* formed adjacent second end 50*c*. Limit means such as cap 58 threadedly affixed to threads 50*d* of rod 50 limits the extent of movement of the rod 50 in relation to opening 42*g*. Further, cap 58 helps to mount and locate a return means such as spring 60 mounted therebetween cap 58 and surface 42*i* of the activator housing 42.

A fluid port 42*j* is preferably formed adjacent surface 42*a* and adapted to receive fluid line segment 22*b* for communication with fluid chamber 54.

The brake actuator means B is of a substantially identical construction having brake actuator housing 62 having a movable rod 64 mounted therewith (FIG. 1) in similar fashion to activator housing 42 and rod 50 therewith.

The sensor means S is preferably mounted with the boom point 12 of the boom 10 by suitable support tabs 66 mounted with the boom point 12 for an appropriate pivotal connection therebetween the sensor means S and the boom point 12 by means of pin 68 for connecting mounting tab 40 and support tab 66 theretogether.

The crane (not shown) is adapted to lift a travelling member T by the lifting line 16. As shown in FIG. 2 the travelling member T may include an appropriate support ring 70 and hook 71 or as shown in FIG. 3 may include a travelling block 72 having appropriate sheaving 72*a* mounted therewith which may in turn support a hook (not shown) such as hook 71 or any other suitable load connective device. Sheaving 72*a* and sheave 14 may be of a multiple sheave arrangement if so desired. Still further, the travelling member T may be of any configuration and used for any purpose, such as a spherical overhaul ball (not shown) or any other crane-operative mechanism.

In the use or operation of the anti-two block system A of the present invention as shown in FIG. 1, the sensor means S is adapted to be mounted with the boom point 12 of the boom 10 and capable of receiving the lifting line 16 therein bore 26 having an appropriate travelling member T mounted therewith. During typical operations of the crane, the sensor means S and the hoisting actuator means H and brake actuator means B are in an initial, unactivated position. The initial, unactivated position for the sensor means S results when the end surface 30*i* of sleeve 30 is in engagement with end surface 24*c* of the body member 24 with the spring 38 being in its fully extended position. The hoisting actuator means H is in its initial, unactuated position when surface 48*e* of piston 48 is in engagement with inner end surface 42*d* of the activator housing 42. The brake actuator means B is in a similar position as the hoisting actuator means H.

During normal operation of the crane, the lifting line 16 moves freely within the bore 26 of the sensor means S. Should the crane operator not be paying the proper attention to lifting of a travelling member T and the lifting line 16 is reeled onto the hoisting drum (not shown) too far, the travelling member T engages the second end 30g of the sleeve 30. The sensor means S thus detects the close proximity of the travelling member T adjacent the boom point 14 of the crane during lifting operations of the travelling member T with the crane. Further upward movement of the travelling member T adjacent the second end 30g of the sleeve 30 results in the sleeve 30 moving upwardly with respect to the body member 24. Such upward movement of the sleeve 30 in fluid within the fluid chamber 36 being forced outwardly therefrom through fluid port 24i into fluid line segment 22a. The discharge from fluid chamber 26 thus charges fluid line segments 22b, 22c, respectively, for activating the hoisting actuator means H and brake actuator means B. The fluid charge from the sensor means S in part enters into fluid chamber 54 therefrom fluid line segment 22b and fluid port 22j. The fluid flowing into fluid chamber 54 acts on end surface 48c of piston 48 forcing the same towards end plate 42c. The fluid pressure on surface 48c overcomes the resistance or bias caused by spring 60 resulting in an extension of the rod 50. The extension of the rod 50 results in its first end 50b engaging and co-acting with the hoisting lever 18 for preventing further upward hoisting of the lifting line 16. In similar fashion, the fluid entering the brake actuator means B through fluid line segment 22c results in outward movement of rod 64 which effects movement and co-acts with the brake lever 20 to stop upward movement of the travelling member T when the travelling member T engages the sensor means S. Thus, upward movement of the travelling member T such that the sensor means is engaged, results in both the hoisting actuator means H and the brake actuator means B co-acting with the hoisting lever 18, braking lever 20, respectively, for effecting movement of the hoisting lever 18 to discontinue the lifting force exerted on the lifting line 16 when the travelling member T engages the sensor means S and for stopping upward movement of the travelling member T by the brake actuator means B. Thus, engagement of the sensor means S by the travelling member T effectively prevents further hoisting of the lifting line 16 while stopping the same. Thus, damage is prevented to the travelling member T, boom point 12 of the boom 10 and/or any load attached to the travelling member T. As such, the risk of injury to those working below the crane is reduced as well as the risk of potential snapping of the lifting line 16 and/or damage to the crane or operator thereof is substantially reduced resulting in safer crane operation during lifting procedures.

As shown in FIG. 2, the sensor means S may be mounted with the boom point 12 wherein the lifting line 16 is rigged according to a live line installation wherein the lifting line 16 extends over a sheave 14, therethrough bore 26 of the sensor means S to the travelling member T. Alternatively, as shown in FIG. 3, the anti-two block system A of the present invention is adapted to also be used for dead line installation such that the lifting line 16 extends over sheave 14, which may be of a multiple sheave arrangement, to travelling block 72 by line 16a, thereabout sheave 72a mounted in the travelling block 72, which may be of a corresponding multiple sheave arrangement, therefrom sheave 72a to an appropriate mounting location such as at pin 68 where the lifting line 16b extending therebetween sheave 72a and pin 68 may be appropriately affixed with the boom point 12 of the boom 10. With either of these configurations of FIGS. 2, 3, the sensor means S is activated by upward urging of the travelling member T upon the second end 30g of the sleeve 30 resulting in a discharge of fluid therefrom as described hereinabove.

The anti-two block system A of the present invention may be deactivated by manually overriding the hoisting actuator means H and the brake actuator means B. Appropriate pressure relief connections R, such as shown schematically affixed to accumulator 23 (FIG. 1) may alternatively be used to release fluid pressure acting on the actuator means such as pressure acting on surface 48c of piston 48. Any other suitable release means may be incorporated.

Thus, the anti-two block system A of the present invention provides for safe crane operation for those operating and working around crane lifting operations.

The foregoing disclosure and description of the invention are illustrative and explanatory thereof, and various changes in the size, shape and materials as well as in the details of the illustrated construction may be made without departing from the spirit of the invention.

We claim:

1. An anti-two block system adapted to be used with a crane, the crane having a boom with a boom point and adapted to lift loads with a lifting line having a travelling member therewith, the crane having hoisting and braking levers for controlling operations thereof, comprising:

sensor means mounted with the boom point of the crane for detecting the close proximity of the travelling member adjacent the boom point of the crane during lifting operations of the travelling member with the crane, said sensor means including:

a body member mounted with the boom point, said body member having a bore formed therethrough for receivably mounting the lifting line of the crane therein and a fluid cavity formed about said bore;

a sleeve having a first end and a second end, said first end adapted to be disposed in said fluid cavity in said body member and said second end adapted to be engaged by the travelling member, said fluid cavity between said first end of said sleeve and said body member forming a fluid chamber;

hoisting actuator means mounted adjacent the hoisting lever of the crane for co-action therewith; and, means operatively connecting said hoisting actuator means and said fluid chamber of said sensor means, said fluid chamber providing a fluid output from said sensor means as a result of longitudinal movement of said sleeve with respect to said body member within said fluid cavity from a first unactivated position to a second engaged position wherein said hoisting actuator means, in communication with said fluid chamber, is activated by said fluid output for effecting movement of the hoisting lever to discontinue the lifting force exerted on the lifting line when the travelling member engages said sensor means.

2. The system of claim 1, further including:

brake actuator means mounted adjacent the braking lever of the crane for co-action therewith; and, means operatively connecting said brake actuator means and said sensor means for effecting movement of the braking lever to stop upward movement of the travelling member when the travelling member engages said sensor means.

3. The system of claim 2, wherein:

said hoisting actuator means and said brake actuator means are of substantially the same form and said connection means is common to both said hoisting actuator means and said brake actuator means.

4. The system of claim 1, further including:

bias means mounted in said fluid chamber for providing bias on said sleeve for maintaining said sensor means in said first unactivated position when the travelling member is not engaging said second end of said sleeve.

5. The system of claim 1, wherein said actuator means includes:

an activator housing having a cavity formed therein and in fluid communication with said sensor means; and, a piston assembly disposed within said cavity for activation from a first unactivated position to a second activated position upon movement of said sensor means from a first unactivated position to a second activated position for preventing further hoisting of the travelling member.

6. The system of claim 5, wherein said piston assembly includes:

a piston movably disposed with said cavity, said piston movable from said first position upon movement of said sensor means from said first position; and, a rod mounted with said piston for effecting movement of the hoisting lever to prevent further hoisting of the travelling member of the crane when the travelling member engages said sensor means.

7. The system of claim 6, further including:

means for limiting the extent of movement of said rod and said piston from said first position to said second position, said means adjustably mounted with said piston assembly.

8. The system of claim 7, wherein said limit means further includes:

return means for retaining said piston in said first position at all times except upon actuation of said actuator means by said sensor means.

9. The system of claim 1, wherein:

the travelling member is a travelling block.

10. The system of claim 1, wherein:

the travelling member is a hook.

11. The system of claim 2, further including:

means for releasing said hoisting actuator means and said brake actuator means after said hoisting and brake actuator means have been actuated to permit further continued use of the crane, said releasing means being in communication with said hoisting and said brake actuator means.

* * * * *